United States Patent [19]

Yamamoto et al.

[11] Patent Number: 4,501,709

[45] Date of Patent: Feb. 26, 1985

[54] VARIABLE VENTURI CARBURETOR

[75] Inventors: Tadahiro Yamamoto, Yokosuka; Tadaki Oota, Fujisawa, both of Japan

[73] Assignee: Nissan Motor Company, Limited, Yokohama City, Japan

[21] Appl. No.: 566,405

[22] Filed: Dec. 28, 1983

[51] Int. Cl.[3] ..... F02M 9/14

[52] U.S. Cl. ..... 261/44 D; 261/DIG. 56

[58] Field of Search ..... 261/44 D, DIG. 56

[56] References Cited

U.S. PATENT DOCUMENTS

| | | | |
|---|---|---|---|
| 1,124,949 | 1/1915 | Raymond | 261/44 D |
| 1,394,536 | 10/1921 | Chase | 261/44 D |
| 1,983,255 | 12/1934 | Wahlmark | 261/44 D |
| 2,646,264 | 7/1953 | Morris | 261/44 D |
| 3,592,449 | 7/1971 | Elgohary | 261/44 D |
| 4,154,781 | 5/1979 | Mineck | 261/44 D |
| 4,387,685 | 6/1983 | Abbey | 261/44 D |

FOREIGN PATENT DOCUMENTS

| | | | |
|---|---|---|---|
| 3142822 | 6/1982 | Fed. Rep. of Germany | 261/44 C |
| 411829 | 4/1910 | France | 261/44 D |

*Primary Examiner*—Tim Miles

*Attorney, Agent, or Firm*—Leydig, Voit, Osann, Mayer and Holt, Ltd.

[57] ABSTRACT

A variable venturi carburetor comprises an auxiliary intake air passage, an auxiliary variable venturi and a non-adjustable nozzle portion, in addition to a main intake air passage, a main variable venturi and an adjustable nozzle portion. If the amount of intake air is small as when the engine is being idled, intake air is passed mainly through the auxiliary variable venturi to generate vacuum sufficiently high to jet fuel into the auxiliary intake passage through the non-adjustable nozzle portion. If the amount of intake air is great as when the engine is running under a heavy load, intake air is passed mainly through the main variable venturi. Since two venturis are formed, it is possible to smoothly increase the amount of fuel to be jetted into the intake passage over a wide engine operating condition.

3 Claims, 2 Drawing Figures

VARIABLE VENTURI CARBURETOR

BACKGROUND OF THE INVENTION

1. Field of the Invention

The present invention relates generally to a variable venturi carburetor for an engine in which the cross-sectional area of venturi portion automatically changes according to the amount of intake air to keep the vacuum generated at the venturi portion at a constant level, regardless of the amount of intake air, the carburetor of this type being called a constant vacuum carburetor. Further, in the carburetor of this type, the metering jet portion of fuel also automatically changes according to the amount of intake air to supply the mixture of a predetermined air-to-fuel ratio.

2. Description of the Prior Art

Variable venturi carburetors or constant vacuum carburetors are well known. The variable venturi carburetor is usually attached to an intake passage on the upstream side from a throttle valve. The venturi portion thereof is formed between a fixed venturi portion and a movable venturi portion. The fixed venturi portion includes a nozzle body having a nozzle portion at one end thereof, the nozzle body being connected to a float chamber to supply fuel from the float chamber to the intake passage. The movable venturi portion includes a suction cylinder, a suction piston the inner space of which is partitioned into an atmospheric pressure chamber and a vacuum chamber, and a suction spring.

The suction piston serving as the movable venturi portion moves toward or away from the fixed venturi portion, in dependence upon the force balance determined by pressure difference between the atmospheric pressure chamber and vacuum chamber, the urging force of the suction spring, and the weight of the suction piston, so that the cross-sectional area of the venturi portion changes according to the amount of intake air to keep vacuum at a constant level at the venturi portion. Further, at the center of the lower end surface of the suction piston, a tapered jet needle is fixed so as to pass through a central hole formed in the needle body. Therefore, when the suction piston moves toward or away from the fixed venturi portion, the metering jet portion formed between the jet needle and the nozzle portion of the nozzle body varies to keep the mixture obtained at the venturi portion at a predetermined air-to-fuel ratio.

However, while the engine is being idled, since the amount of intake air is very small, the vacuum generated at the venturi is too low to sufficiently absorb fuel through the metering jet portion, even if the movable venturi portion moves at its lowermost position. To overcome this problem, the prior-art variable venturi carburetor is usually combined with an additional fixed venturi carburetor including a main nozzle, a low-speed jet, a by-pass pilot fuel supply passage, and a low-speed air passage. Accordingly, there exist problems in that the structure is complicated and further it is rather difficult to obtain a stable mixture of a predetermined air-to-fuel ratio while the engine is being idled or to smoothly increase the amount of fuel according to the increase in the amount of intake air when engine load increases gradually from engine idling condition.

A more detailed description of the prior-art variable venturi carburetor will be made with reference to the attached drawings under DETAILED DESCRIPTION OF THE PREFERRED EMBODIMENT.

SUMMARY OF THE INVENTION

With these problems in mind, therefore, it is the primary object of the present invention to provide a simple variable venturi carburetor by which a sufficient vacuum can be generated at the venturi in order to supply fuel into an intake passage through a jet portion and therefore a stable mixture of a predetermined air-to-fuel ratio can be obtained even when the engine is being idled, and additionally the amount of fuel can smoothly be increased according to the increase in the amount of intake air when engine load increases gradually from engine idling condition.

To achieve the above-mentioned object, the variable venturi carburetor according to the present invention comprises a carburetor body formed with a main fixed venturi portion, a fuel supply member formed with a first nozzle, a second nozzle and an auxiliary fixed venturi portion, a suction piston formed with a main movable venturi portion, an auxiliary movable venturi portion and a communication hole, a main venturi being formed between the main fixed venturi portion of the carburetor body and the main movable venturi portion of the suction piston, an auxiliary venturi being formed between the auxiliary fixed venturi portion of the fuel supply member and the auxiliary movable venturi portion of the suction piston, a suction piston being moved toward or away from the fuel supply member by the vacuum generated due to air passing through the auxiliary venturi, and a tapered jet needle attached to the suction piston so as to pass through the second nozzle portion formed in the fuel supply member. If the amount of intake air is small as when the engine is being idled, intake air is passed mainly through the auxiliary variable venturi in order to generate vacuum sufficiently high to jet fuel into the auxiliary intake air passage through the first nozzle. If the amount of intake air is great as when the engine is running under a heavy load, intake air is passed mainly through the main variable venturi. Since two venturis are formed and two cross-sectional areas of the two venturis are so designed as to change in a predetermined relation to each other, it is possible to smoothly increase the amount of fuel to be jetted into the intake passage over a wide range from engine idling condition to engine heavy-load operating condition.

BRIEF DESCRIPTION OF THE DRAWINGS

The features and advantages of the variable venturi carburetor according to the present invention over the prior-art variable venturi carburetor will be more clearly appreciated from the following description of the preferred embodiment of the invention taken in conjunction with the accompanying drawings in which some like reference numerals designate the same or similar elements or sections throughout the figures thereof and in which.

DETAILED DESCRIPTION OF THE PREFERRED EMBODIMENTS

Generally, a variable venturi carburetor is called a constant vacuum carburetor in which the cross-sectional area of venturi is automatically adjusted according to the amount of intake air in order to maintain the vacuum generated at the venturi portion at a constant level, and further the metering jet area formed between a nozzle body and a needle is also automatically adjusted according to the variation in venturi cross-sectional area in order to supply a mixture of a predetermined air-to-fuel ratio into the engine.

To facilitate understanding of the present invention, a reference will be made hereinbelow to a prior-art variable venturi carburetor for an engine, with reference to the attached drawing.

Figure 1:
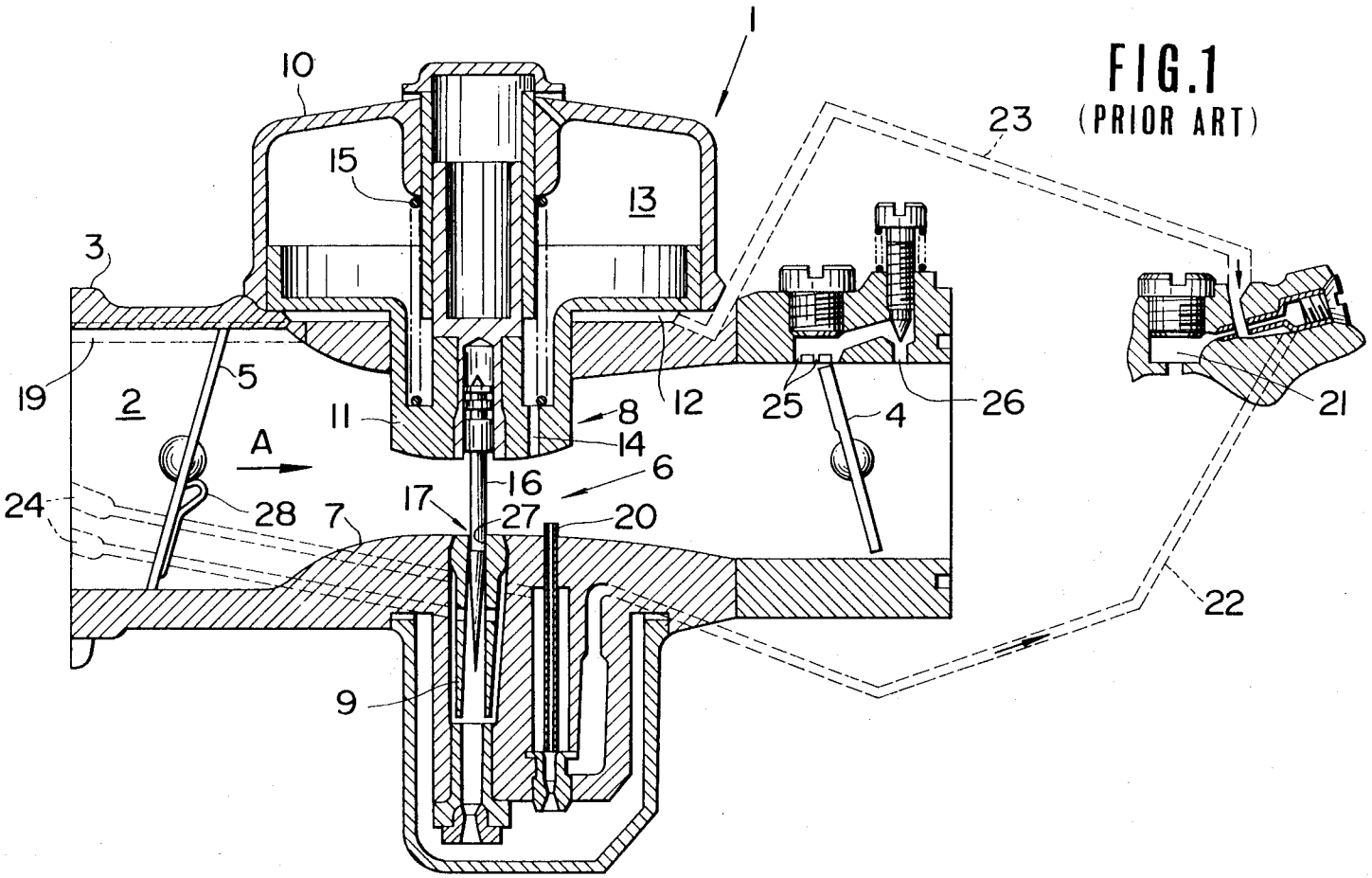
FIG. 1 (PRIOR ART)
FIG. 1 is a cross-sectional view showing an example of prior-art variable venturi carburetors for engines.

FIG. 1 shows an example of prior-art variable venturi carburetors, which is described in a book titled "Carburetors" by Takashi Yoshida, published from TETSUDO NIPPON-SHA. The variable venturi carburetor 1 is attached to an intake passage 2 within an intake pipe 3 upstream of a throttle valve 4 connected to an accelerator pedal (not shown). In FIG. 1, the upstream (left) side of the intake passage 2 is connected to an air cleaner (not shown) and the downstream (right) side of the intake passage 2 is connected to an engine. The reference numeral 5 denotes a choke valve. The arrow A denotes the direction that air flows within the intake passage 2.

The variable venturi 6 is formed between a fixed venturi portion 7 and a movable venturi portion 8. The fixed venturi portion 7 is formed with a projection projecting inwardly from the inner wall of the intake pipe 3 and extending in flat state when seen through the intake passage 2. A nozzle body 9 is fitted to a hole formed near the center of the fixed venturi portion 7. The lower portion of the nozzle body 9 communicates with a float chamber (not shown) in order to jet fuel from the foat chamber to the variable venturi 6 through the nozzle body 9.

The movable venturi portion 8 is made up of a suction cylinder 10 attached to the intake pipe 3 on the opposite side of the fixed venturi portion 7 and a suction piston 11 slidably fitted to the suction cylinder 10 so as to partition the inside of the suction cylinder 10 into an atmospheric pressure chamber 12 and a vacuum chamber 13. Further, the variable venturi 6 is formed between the bottom surface of the suction piston 11 (the movable venturi portion) and the fixed venturi portion 7. Atmospheric pressure is introduced into the atmospheric pressure chamber 12 through atmosphere holes 19 and venturi vacuum at venturi 6 is introduced into the vacuum chamber 13 through a suction hole 14 formed in the lower portion of the suction piston 11. The suction piston 11 urged toward the fixed venturi portion 7 by a suction spring 15 disposed in compression mode within the vacuum chamber 13. Therefore, the suction piston 11 moves toward or away from the fixed venturi portion 3 in dependence upon the force balance determined by the difference in pressure between the atmospheric pressure chamber 12 and the vacuum chamber 13, the urging force of the suction spring 15 and the weight of the suction piston 11 itself.

At the center of the bottom of the suction piston 11, a tapered jet needle 16 is adjustably fixed passing through a nozzle portion 27 formed at the top end of the nozzle body 9. Therefore, an annular metering jet portion 17 is formed between the tapered jet needle 16 and the nozzle portion 27 of the nozzle body 9. The area of this annular metering jet portion 17 increases when the suction piston 11 moves upwards away from the fixed venturi portion 7 and decreases when the suction piston 11 moves downward toward the fixed venturi portion 7.

In the variable venturi carburetor as described above, the suction piston 11 moves toward or away from the fixed venturi portion 7 in dependence upon the vacuum generated at the venturi 6, that is, the amount of intake air. As a result, the area of the metering jet portion varies according to the stroke of the suction piston 11. In more detail, when the throttle valve 4 is widely opened, the amount of intake air increases, so that a high vacuum is generated at the venturi 6. As a result, this vacuum is introduced into the vacuum chamber 13 through the suction hole 14, so that the suction piston 11 is moved upward away from the fixed venturi portion 7 to increase the cross-sectional area of the venturi 6. Therefore, the area of the annular metering jet portion 17 increases, so that a greater amount of fuel corresponding to the greater amount of intake air is jetted into the intake passage 2 through the metering jet portion 17.

On the other hand, when the throttle valve 4 is opened a little, since the amount of intake air is small, the vacuum generated at the venturi 6 is not high. Therefore, the suction piston 11 moves in the downward direction to decrease the cross-sectional area of the venturi 6. Therefore, the area of the annular metering jet portion 17 decreases, so that a smaller amount of fuel corresponding to the smaller amount of intake air is jetted into the intake passage 2 through the metering jet portion 17. As the variable venturi carburetor is called a constant vacuum carburetor, the vacuum at the venturi 6 is always kept roughly at a predetermined level regardless of the amount of intake air. This is because the cross-sectional area of venturi portion varies roughly in proportion to the amount of intake air. Additionally, the air-to-fuel ratio is always kept at a constant level regardless of the amount of intake air. This is because the area of the metering jet portion 17 varies roughly in proportion to the amount of intake air.

In the variable venturi carburetor as described above, while the engine is being idled, since the amount of intake air is very small, the vacuum generated at the venturi 6 is too low to sufficiently absorb fuel through the metering jet portion 17, even if the movable venturi portion 8 moves toward the fixed venturi portion 6 to its lowermost position; that is, if the cross-sectional area of the venturi 6 becomes the minimum. To overcome the above-mentioned problem, an additional fixed venturi function is provided. As this function, the carburetor further includes a main nozzle 20, a low-speed jet 21, a by-pass pilot fuel supply passage 22 and a low-speed air passage 23. The main nozzle 20 is disposed at the variable venturi. Fuel supplied through the by-pass pilot fuel supply passage 22 and air fed through the low-speed air passage 23 are mixed at the low-speed jet 21. The mixture obtained at the low-speed jet 21 is jetted into the intake passage 2.

Further, in FIG. 1, the reference numeral 24 denotes two air-bleed passages communicating with the nozzle body 9 and the main nozzle 20; the reference numeral 25 denotes a by-pass nozzle; the reference numeral 26 denotes a pilot nozzle; the reference numeral 28 denotes a relief valve.

In summary, in the prior-art carburetor shown in FIG. 1, the fixed venturi carburetor is additionally provided for the adjustable venturi carburetor. Therefore, there exist problems in that (1) the structure including the main nozzle 20, the low-speed jet 21, etc. is complicated; (2) it is difficult to produce a stable mixture of a predetermined air-to-fuel ratio especially when engine load increases a little beyond engine idling conditions; (3) it is also difficult to smoothly increases the amount of fuel according to the increase in the amount of intake air from the time when the engine is being idled to the time when the engine is operated under a medium or heavy load.

In view of the above description, reference is now made to the embodiment of the variable venturi carburetor according to the present invention. The structure of this embodiment is down-draft type variable venturi carburetor provided with main and auxiliary variable venturis.

The feature of the variable venturi carburetor according to the present invention is as follows: (1) Intake air is passed mainly through an auxiliary venturi to generate vacuum enough to jet fuel into an auxiliary intake air passage through a non-adjustable jet needle when the amount of intake air is small as when the engine is being idled; (2) The vacuum generated at the auxiliary venturi increases high as the amount of intake air increases. As a result, suction piston 70 moves in the upward direction, the cross-sectional area of a main venturi increases, and thereby the amount of intake air also increases. Therefore, intake air is passed mainly through a main venturi when the amount of intake air is great as when the engine is being operated under a heavy load. (3) The amount of fuel absorbed from a metering jet is determined by the upward movement of the suction piston 70, that is, the vacuum generated at the auxiliary venturi. (4) Since the auxiliary venturi is operative over a wide engine operation range from idling condition to heavy load condition, the amount of fuel jetted into the intake passage can smoothly be increased over the wide range.

Figure 2:
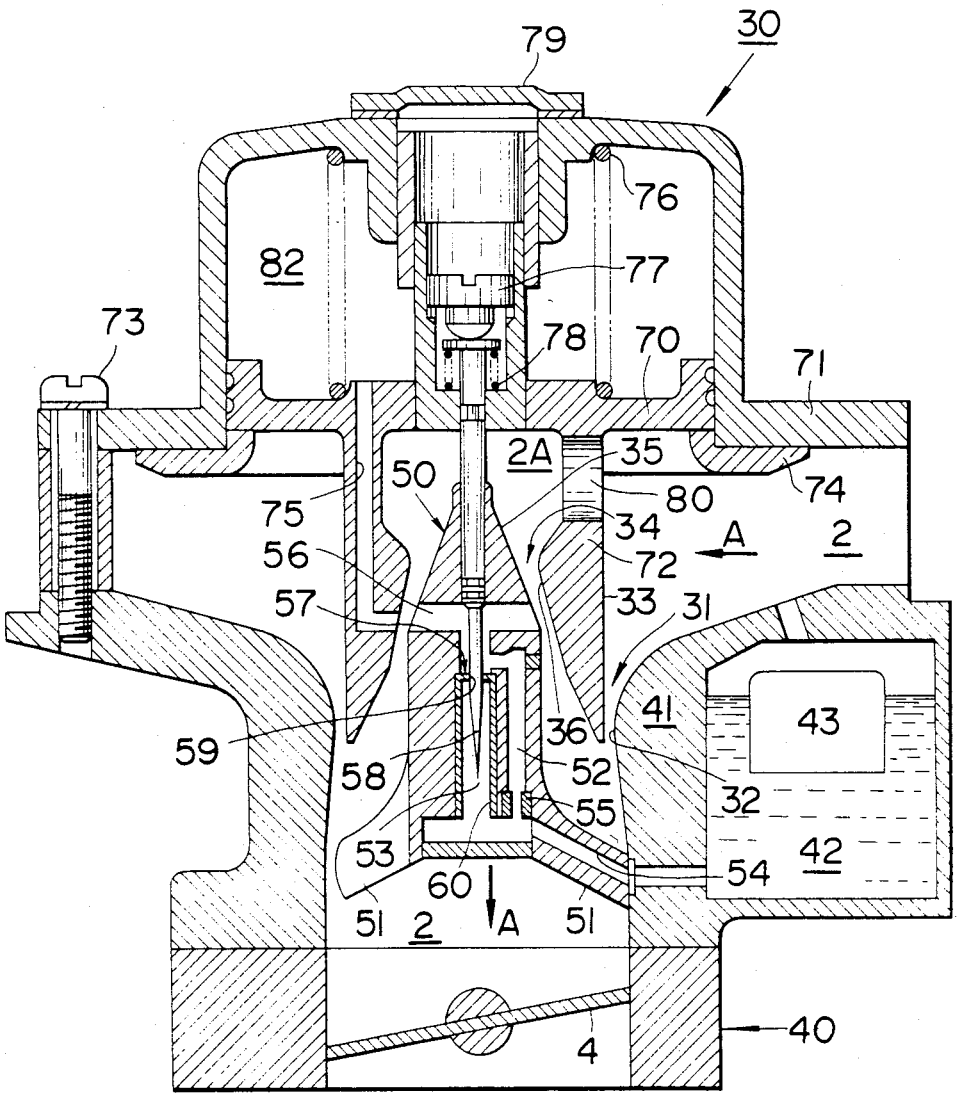
FIG. 2 is a cross-sectional view showing the variable venturi carburetor for an engine according to the present invention.

With reference to FIG. 2, the variable venturi carburetor 30 of down-draft type according to the present invention roughly comprises a carburetor body 71 of T-shaped cross-section, a rocket-shaped fuel supply member 50 and a suction piston 70. The main venturi 31 is formed between a main fixed venturi portion 32 which is projecting from the inner wall of the angular portion of the carburetor body 71 and a main movable venturi portion 33 which is the outer flat peripheral surface of a cylindrical portion 72 of the suction piston 70. The auxiliary venturi 34 is formed between an auxiliary fixed venturi portion 35 of the top of the rocket-shaped fuel supply member 50 and an auxiliary movable venturi portion 36 of the inner projecting peripheral surface of the cylindrical portion 72 of the suction piston 70. The main passage 2 is formed mainly within the carburetor body 71 and the auxiliary passage 2A is formed within the cylindrical portion 72 of the suction piston 70. The variable venturi carburetor 30 is disposed on the upstream side of a throttle valve 4 mechanically connected to an accelerator pedal (not shown). Further, the arrows A show the direction that intake air flows through the intake passage 2 or 2A.

The carburetor body 71 is so disposed as to form the main intake passage 2 in such a way that the horizontal portion thereof communicates with atmosphere via an air cleaner (not shown) and the vertical portion thereof communicates with an intake manifold (not shown) of an engine via throttle valve 4.

The roughly rocket-shaped fuel supply member 50 is fixedly supported vertically within the main intake passage 2 by a plurality of supporting beams 51. The supporting beams 51 are formed at the bottom of the fuel supply member 50 being spaced at equal angular intervals. In the fuel supply member 50, there are formed a first fuel supply passage 52 and a second fuel supply passage 53 in parallel to each other vertically. These two fuel supply passages 52 and 53 communicate with a float chamber 42 through a communication passage 54 formed in one of the supporting beams 54. The first fuel supply passage 52 communicates with the communication passage 54 through a first fixed nozzle portion 55 at the lower portion of the member 50 and simultaneously with a jet port 56 at the upper portion of the member 50. The second adjustable fuel supply passage 53 communicates directly with the communication passage 54 at the lower end and simultaneously with the jet port 56 through a nozzle portion 59.

A nozzle guide 60 is fitted to a hole formed at the center of the rocket-shaped fuel supply member 50. The nozzle portion 59 is formed at the top of this nozzle guide 60. Therefore, a metering jet portion 57 is formed between a jet needle 58 and the nozzle portion 59.

Fuel is supplied from the float chamber 42 to the first and second fuel supply passages 52 and 53 via the communication passage 54. On the other hand, fuel is supplied from a fuel tank (not shown) to the float chamber 42 via a needle valve (not shown). A float 43 is moved up and down according to the amount of fuel within the float chamber 42 in order to open or close the needle valve, so that the amount of fuel within the float chamber 42 is always kept at a constant level.

The suction piston 70 includes the cylindrical portion 72 extending downward within the vertical portion of the carburetor body 71 to form an auxiliary intake passage 2A, being disposed on the opposite side of the two fixed venturi portions 32 and 35. The suction piston 70 is slidably fitted to the cylindrical portion of the carburetor body 71 so as to form a vacuum chamber 82. The vacuum generated at venturi 34 is introduced into the vacuum chamber 82 through a suction hole 75 formed vertically in the cylinder portion 72 of the suction piston 70, and the auxiliary intake passage 2A formed within the cylindrical portion 72 communicates with the main intake air passage 2 through a communication hole 80 formed horizontally also in the cylindrical portion 72 of the suction piston 70.

The suction piston 70 is urged toward the fixed venturi portions 32 and 35 by a suction spring 76 disposed in compression mode within the vacuum chamber 82. Therefore, the suction piston 70 moves toward or away from the fixed venturi portions 32 and 35 in dependence upon the force balance determined by the difference in pressure between the atmospheric pressure within the main intake air passage 2 and the vacuum chamber 73, the urging force of the suction spring 76 and the weight of the suction piston 70 itself. At the center of the suction piston 70, the top end of the tapered jet needle 58 is slidably fitted in such a way that the tapered jet needle 58 passes through the second nozzle portion 59 formed at the top end of the nozzle body 60 in order to form a metering jet portion 57. Accordingly, an annular metering jet portion 57 is formed between the tapered jet needle 58 and the nozzle portion 59 of the nozzle body 60. The area of this annular metering jet increases when the suction piston 70 moves away from the fixed venturi portions 32 and 35 and decreases when the suction piston 70 moves toward the fixed venturi portions 32 and 35. Further, the reference numeral 77 denotes an adjusting screw for initially adjusting the mutual relationship between the jet needle 58 and the nozzle portion 59 in cooperation with an adjusting spring 78. The reference numeral 79 denotes a lid to close the vacuum chamber 82 airtightly; the reference numeral 74 denotes a stopper member to stop the movement of the suction piston 70.

The above mentioned fixed jet nozzle 55, the metering jet portion 57 including the jet needle 58 and the nozzle portion 59, and the adjusting spring 78 are members for constructing valve means; and the suction piston 70, the spring 76, the stopper member 74, the suction piston cylinder 72, the vacuum chamber 82 and the main intake passage 2 are members for constructing actuator means.

In FIG. 2, no atmospheric chamber is provided under the suction piston 70, being different from the carburetor shown in FIG. 1. This is because no venturi portion is formed near under the suction piston 70, and therefore the pressure just near the suction piston 70 is substantially equal to atmospheric pressure within the main intake passage 2 communicating with the outside via an air cleaner.

Further, in the state shown in FIG. 2, the cross-sectional area of the main venturi 31 and that of the auxiliary venturi 34 and the diameter and position of the communication hole 80 are very important. This is because sufficiently high vacuum must be generated at the auxiliary venturi 34 by the air passing through the communication hole 80 and the auxiliary intake air passage 2A, in order to jet fuel into the auxiliary venturi 34, even if the amount of intake air is small as when the engine is being idled.

In the variable venturi carburetor as described above, the suction piston 70 is moved toward or away from the fixed venturi portions 32 and 35 in dependence upon the vacuum generated at the venturi 34, that is, the amount of intake air; as a result, the area of the metering jet portion 57 varies according to the stroke of the suction piston 70. In more detail, when the throttle valve 4 is widely opened, the amount of intake air increases, so that a great vacuum is generated at the venturi 34. Therefore, this vacuum is introduced into the vacuum chamber 82 through the suction hole 75 to the upper side of the suction piston 70, so that the suction piston 70 is moved upward away from the fixed venturi portions 32 and 35 to increase the cross-sectional area of the two venturis. Therefore, the area of the annular metering jet portion 57 increases, so that a greater amount of fuel corresponding to the greater amount of intake air is jetted into the intake passages 2 and 2A through the metering jet portion 57.

On the other hand, when the throttle valve 4 is opened a little, since the amount of intake air is small, the vacuum generated at the venturi 34 is not great. Therefore, the suction piston 70 is moved in the downward direction to decrease the cross-sectional area of the two venturis. Therefore, the area of the annular metering jet portion 57 decreases, so that a smaller amount of fuel corresponding to the smaller amount of intake air is jetted into the intake passages 2 and 2A through the metering jet portion 57.

The operation of the variable venturi carburetor according to the present invention will be described hereinbelow.

When an engine is in idling condition, the amount of intake air is small and therefore the vacuum generated at the two venturis 31 and 34 is low. Accordingly, the suction piston 70 is moved toward the fixed venturi portions 32 and 35 to the lowermost position, as shown in FIG. 2. Under this condition, since the cross-sectional area of the main venturi 31 is relatively small, air introduced into the main intake passage 2 through the air cleaner is mainly passed through the auxiliary venturi portion 34 after flowing through the communication hole 80. As already described, since the cross-sectional area of the auxiliary venturi portion 34 is so determined that a sufficient vacuum can be generated at the auxiliary venturi 34, fuel is supplied from the float chamber 42 to the auxiliary venturi 34 through the communication passage 54, the fixed jet portion 55, the first fuel passage 52 and the jet port 56, while being metered through the fixed nozzle portion 55.

When load applied to the engine increases and therefore the amount of intake air increases, the vacuum generated at the auxiliary venturi 34 becomes high. Accordingly, the suction piston 72 is moved away from the fixed venturi portions 32 and 35 in the upward direction in FIG. 2. Under these conditions, air introduced into the main intake passage 2 is passed through both the auxiliary venturi portion 34 and the main venturi portion 31. As a result, the jet needle 58 is also moved upward to increase the area of the metering jet portion 57, so that the amount of fuel jetted into the intake passage 2A increases in order to keep the air-to-fuel ratio substantially at a constant level.

Here, it should be noted that the upward movement of the suction piston 70, that is, the amount of fuel jetted into the intake passage is determined in dependence upon the vacuum generated at the auxiliary venturi 34. Further, since the auxiliary venturi 34 is operative over a wide engine operation range from idling condition to heavy load condition, the suction piston 70 moves in the upward direction smoothly and gradually with the increasing amount of intake air, and the amount of fuel jetted from the variable metering jet portion 57 increases gradually over the wide engine operation range. Especially, when load increases a little heavier than that in engine idling, it is possible to maintain air-to-fuel ratio at a constant level by metering the amount of fuel through the fixed nozzle portion, without additionally providing a low-speed jet as shown in FIG. 1.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A variable venturi carburetor for an engine, which comprises:

(a) a carburetor body formed with a main fixed venturi portion, said carburetor body forming a main intake passage;

(b) a fuel supply member formed with a first nozzle, a second nozzle and an auxiliary fixed venturi portion on the outer surface thereof;

(c) a suction piston formed with a main movable venturi portion, an auxiliary movable venturi portion and a communication hole, said piston forming an auxiliary intake passage therewithin, the main intake passage communicating with the auxiliary intake passage through the communication hole;

(d) a main venturi formed between the main fixed venturi portion of said carburetor body and the main movable venturi portion of said suction piston;

(e) an auxiliary venturi formed between the auxiliary fixed venturi portion of said fuel supply member and the auxiliary movable venturi portion of said suction piston;

(f) said suction piston being moved toward or away from said fuel supply member by the vacuum generated due to air passing through the auxiliary venturi; and (g) a tapered jet needle attached to said suction piston so as to pass through the second nozzle portion formed in said fuel supply member in order to increase the amount of fuel jetted to the auxiliary intake passages with increasing amount of intake air.

2. A variable venturi carburetor for an engine, which comprises:

(a) a carburetor body attached to an intake passage, said body being formed with a main fixed venturi portion;

(b) a fuel supply member fixed within said carburetor body, said member being formed with a first nozzle portion, a second nozzle portion and a jet port, the first and second nozzle portions communicating with a float chamber on one hand and with an intake passage through the jet port on the other hand, an auxiliary fixed venturi portion being formed near the jet port;

(c) a suction piston having a cylindrical portion to form an auxiliary intake passage therewithin, the outer peripheral portion of which is a main movable venturi portion in relation to the main fixed venturi portion of said carburetor body and the inner projecting portion of which is an auxiliary movable venturi portion in relation to the auxiliary fixed venturi portion of said fuel supply member, a communication hole being formed to introduce intake air from the main intake passage to the auxiliary intake passage, said suction piston being moved toward or away from said two main and auxiliary fixed venturi portions by the vacuum generated due to air passing through an auxiliary venturi formed between the auxiliary fixed and movable venturi portions, in order to vary the cross-sectional areas of the two venturis; and (d) a tapered jet needle attached to the end of said suction piston so as to pass through the second nozzle portion formed in said fuel supply member in order to increase the amount of fuel jetted to the auxiliary intake passage with increasing amount of intake air.

3. A variable venturi carburetor for an engine comprising:

(a) a carburetor body of T-shaped cross-section, the horizontal portion of which communicates with atmosphere and the vertical portion of which communicates with the engine, said carburetor body forming a main intake passage, a main fixed venturi portion being formed projecting from the inner wall of the angular portion of said carburetor body;

(b) a rocket-shaped fuel supply member fixed vertically within said carburetor body and near the angular portion of said carburetor body, said member being formed with a first fuel supply passage provided with a first nozzle portion, a second fuel supply passage provided with a second nozzle portion and a jet port, said two fuel supply passages communicating with a float chamber at one end thereof and with the intake passage through the jet port at the other end thereof, the outer top end of said member forming an auxiliary fixed venturi portion;

(c) a suction piston provided with a cylindrical portion extending within the vertical portion of said carburetor body to form an auxiliary intake passage, the outer peripheral portion of the cylindrical portion forming a main movable venturi portion in relation to the main fixed venturi portion of said carburetor body and the inner projecting portion of the cylindrical portion forming an auxiliary movable venturi portion in relation to the auxiliary fixed venturi portion of said rocket-shaped fuel supply member, a communication hole being formed to introduce intake air from the main intake passage to the auxiliary intake passage, said suction piston being moved toward or away from said two fixed venturi portions by the vacuum generated due to air passing through an auxiliary venturi formed between the auxiliary fixed and movable venturi portions, in order to vary the cross-sectional areas of the two venturis; and (d) a tapered jet needle attached to the lower end of said suction piston so as to pass through the second nozzle portion formed in said fuel supply member, in order to increase the amount of fuel jetted to the auxiliary intake passages with increasing amount of intake air.

* * * * *